US009657936B2

(12) United States Patent
Carr, Jr. et al.

(10) Patent No.: US 9,657,936 B2
(45) Date of Patent: May 23, 2017

(54) SYSTEMS AND METHODS FOR ILLUMINATING AN OBJECT

(71) Applicant: George Allen Carr, Jr., Scottsdale, AZ (US)

(72) Inventors: George Allen Carr, Jr., Scottsdale, AZ (US); Eric Crown, Phoenix, AZ (US)

(73) Assignee: George Allen Carr, Jr., Scottsdale, AZ (US)

( * ) Notice: Subject to any disclaimer, the term of this patent is extended or adjusted under 35 U.S.C. 154(b) by 0 days.

(21) Appl. No.: 14/246,444

(22) Filed: Apr. 7, 2014

(65) Prior Publication Data

US 2015/0055339 A1 Feb. 26, 2015

Related U.S. Application Data

(60) Provisional application No. 61/876,833, filed on Sep. 12, 2013, provisional application No. 61/869,058, filed on Aug. 22, 2013.

(51) Int. Cl.

| | |
|---|---|
| ***F21V 33/00*** | (2006.01) |
| ***A47L 9/30*** | (2006.01) |
| ***F21V 14/02*** | (2006.01) |

(52) U.S. Cl.

CPC ..... *F21V 33/0044* (2013.01); *A47L 9/30* (2013.01); *F21V 14/02* (2013.01)

(58) Field of Classification Search

CPC .... G05D 1/0231; F21V 21/145; F21V 21/092
USPC ..... 362/234, 96
See application file for complete search history.

(56) References Cited

U.S. PATENT DOCUMENTS

| | | | | |
|---|---|---|---|---|
| 5,341,540 | A | 8/1994 | Soupert et al. | |
| 6,069,937 | A | 5/2000 | Oshino et al. | |
| 6,087,645 | A * | 7/2000 | Kitajima et al. | 250/203.1 |
| 6,769,790 | B2 * | 8/2004 | Fruhm et al. | 362/286 |
| 6,993,165 | B2 * | 1/2006 | McClurg et al. | 382/124 |
| 7,121,010 | B2 * | 10/2006 | Marshall | G01C 15/004 33/227 |
| 7,174,655 | B1 * | 2/2007 | Gibbons et al. | 33/761 |
| 7,334,918 | B2 * | 2/2008 | Newton et al. | 362/239 |

(Continued)

OTHER PUBLICATIONS

International Search Report and Written Opinion for International Application PCT/US14/33186 mailed Aug. 15, 2014.

*Primary Examiner* — Anh Mai
*Assistant Examiner* — Matthew Peerce
(74) *Attorney, Agent, or Firm* — Greenberg Traurig, LLP; Chinh H. Pham; Robert L. Hover

(57) ABSTRACT

A system for illuminating an object comprises a plurality of light beams; an emission region from which the plurality of light beams is emitted; and an illumination zone defined by placement of the light beams and being projected in a manner to maximize illumination of the object. A method for illuminating an object using a system comprising one or more light sources comprises generating a plurality of light beams; placing the light beams to define an illumination zone; and positioning the system such that the object falls within the illumination zone. A system for illuminating an object comprises a body having one or more openings in an outer surface; one or more light sources configured to generate a plurality of light beams; and a rotation mechanism configured to rotate the plurality of light beams to form a contiguous effective illumination zone configured to illuminate an object disposed anywhere therein.

18 Claims, 9 Drawing Sheets

(56) References Cited

U.S. PATENT DOCUMENTS

| | | | | |
|---|---|---|---|---|
| 7,487,596 | B2 * | 2/2009 | Nash | G01C 15/002 33/276 |
| 7,736,008 | B2 * | 6/2010 | Quattrini, Jr. | 362/91 |
| 7,797,844 | B2 * | 9/2010 | Hobden et al. | 33/286 |
| 8,085,410 | B1 * | 12/2011 | Hargabus | 356/614 |
| 8,446,288 | B2 * | 5/2013 | Mizushima et al. | 340/691.6 |
| 2002/0051360 | A1 | 5/2002 | Solodovnikov et al. | |
| 2006/0179672 | A1 * | 8/2006 | Tacklind | 33/286 |
| 2010/0296285 | A1 | 11/2010 | Chemel et al. | |
| 2011/0310592 | A1 | 12/2011 | Smith | |
| 2012/0081884 | A1 * | 4/2012 | Gonzalez | 362/103 |
| 2013/0331990 | A1 * | 12/2013 | Jeong et al. | 700/259 |
| 2013/0338831 | A1 * | 12/2013 | Noh et al. | 700/259 |
| 2014/0111812 | A1 * | 4/2014 | Baeg et al. | 356/610 |
| 2015/0055323 | A1 * | 2/2015 | Schreiber | 362/96 |

* cited by examiner

SYSTEMS AND METHODS FOR ILLUMINATING AN OBJECT

CROSS-REFERENCE TO RELATED APPLICATIONS

This application claims priority to U.S. Provisional Patent Application No. 61/876,833, entitled "Floor Object Finder," filed on Sep. 12, 2013, and to U.S. Provisional Patent Application No. 61/869,058, entitled "Broken Glass Finder," filed on Aug. 22, 2013, both of which are hereby incorporated by reference for all purposes.

TECHNICAL FIELD

The present invention relates to illumination systems, and more particularly, a system for illuminating an object on a surface to facilitate detection and removal.

BACKGROUND

It can sometimes be difficult to find certain objects or substances on a floor or other surface. Things like broken glass and slippery liquids may pose bodily hazards if left undetected on a surface. Liquids, especially those with corrosive or staining properties, may damage a surface and other things they contact. Jewelry and other valuable items may be lost or broken if not quickly found. Generally speaking, it can be especially difficult to find objects of small size, high transparency, and/or similar coloration as a surface on which they are disposed.

Current illumination systems for finding objects on a surface have some disadvantages. In one aspect, some systems may require a user to move around and contort into awkward positions in order to see any light reflected off an object. In another aspect, some systems may create a glare on the surface making it difficult to visually detect and distinguish an object thereon. In yet another aspect, illumination used by some systems may be weak or unconcentrated, thereby exhibiting limited detection capability beyond certain distances. Conversely, some systems may be too focused and exhibit a limited span of detection coverage, thereby making it difficult, tedious, time-consuming, and sometimes a matter of luck to eventually illuminate an object on a surface and then not miss it visually. In still another aspect, systems may not be submersible or otherwise capable of detecting objects on a submerged surface, such as the bottom of a swimming pool. It can be very costly and inconvenient to find and remove hazardous objects such as broken glass from the bottom of a swimming pool, as often the pool must be completely drained to ensure all shards are found.

In light of these issues, it would be desirable to provide a way to easily illuminate an object on a surface and do so with confidence that most, if not all, such objects that may be present are located.

SUMMARY OF THE INVENTION

The present disclosure is directed to a system for illuminating an object, the system comprising: a plurality of light beams; an emission region from which the plurality of light beams is emitted; and an illumination zone defined by placement of the light beams emitted from the emission region and being projected in a manner to maximize illumination of the object.

In an embodiment, at least one of the light beams may have a substantially circular cross-section. In another embodiment, at least one of the light beams may have a substantially non-circular cross-section. In an embodiment, placement of the light beams may be a function of a direction in which the light beams are emitted, and a location in the emission region from which the light beams are emitted. In another embodiment, placement may be a function of an orientation of the light beams having non-circular cross-sections.

In various embodiments, the emission zone may be disposed about a periphery of a body, and the body may be configured to direct the plurality of light beams. In an embodiment, the body may comprise a placement mechanism for vectoring the plurality of light beams through the emission region. In another embodiment, the placement mechanism may locate and direct a corresponding light source from which a given beam light beam is emitted. In yet another embodiment, the body may comprise a rotation mechanism for rotating the plurality of light beams about an axis of the body.

An embodiment may comprise a strap for wearing the system. In another embodiment, the system may be coupled with a dustpan.

In another aspect, the present disclosure is directed to a method for illuminating an object using a system comprising one or more light sources, the method comprising: generating a plurality of light beams; placing the light beams to define an illumination zone; and positioning the system such that the object falls within the illumination zone formed by the plurality of light beams.

In an embodiment, the step of generating may comprise generating one or more line-shaped light beams.

In an embodiment, the step of placing may comprise selecting a corresponding location from which each light beam is emitted. In another embodiment, the step of placing may comprise selecting a corresponding direction in which each light beam is emitted. In yet another embodiment, the step of placing may comprise selecting a corresponding orientation of each emitted light beam. In still another embodiment, the step of placing may comprise rotating the plurality of light beams about an axis of the system.

In an embodiment, the step of positioning may comprise positioning the system on or above a surface on which the object is disposed. In another embodiment, the step of positioning may comprise moving the system along a sweep path.

In yet another aspect, the present disclosure is directed to a system for illuminating an object, the system comprising: a body having one or more openings in an outer surface; one or more light sources configured to generate a plurality of light beams, the light sources disposed within the body and emitting the plurality of light beams through the openings; and a rotation mechanism configured to rotate the plurality of light beams about an axis of the body; wherein rotation of the plurality of light beams forms a contiguous effective illumination zone about a circumference of the body being configured to illuminate an object disposed anywhere therein.

BRIEF DESCRIPTION OF DRAWINGS

For a more complete understanding of this disclosure, reference is now made to the following description, taken in conjunction with the accompanying drawings, in which.

DESCRIPTION OF SPECIFIC EMBODIMENTS

Embodiments of the present disclosure generally provide a system 100 for illuminating an object 102 on a surface 104.

FIGS. 1-5 illustrate representative configurations of system 100 and parts thereof. It should be understood that the components of system 100 and parts thereof shown in FIGS. 1-5 are for illustrative purposes only, and that any other suitable components or subcomponents may be used in conjunction with or in lieu of the components comprising system 100 and the parts of system 100 described herein.

Embodiments of system 100 may provide for illuminating an object 102 on a surface 104. Object 102 may comprise any object, substance, or thing capable of reflecting or refracting light in a visible manner. Object 102 may be disposed on surface 104. Surface 104 may comprise any surface suitable to support at least a portion of object 102 thereon, such as a floor, countertop, pool bottom, or the like, as well as, in some embodiments, a liquid surface, such as that of a swimming pool. In such embodiments, objects 102 may float on or near surface 104.

Figure 1:
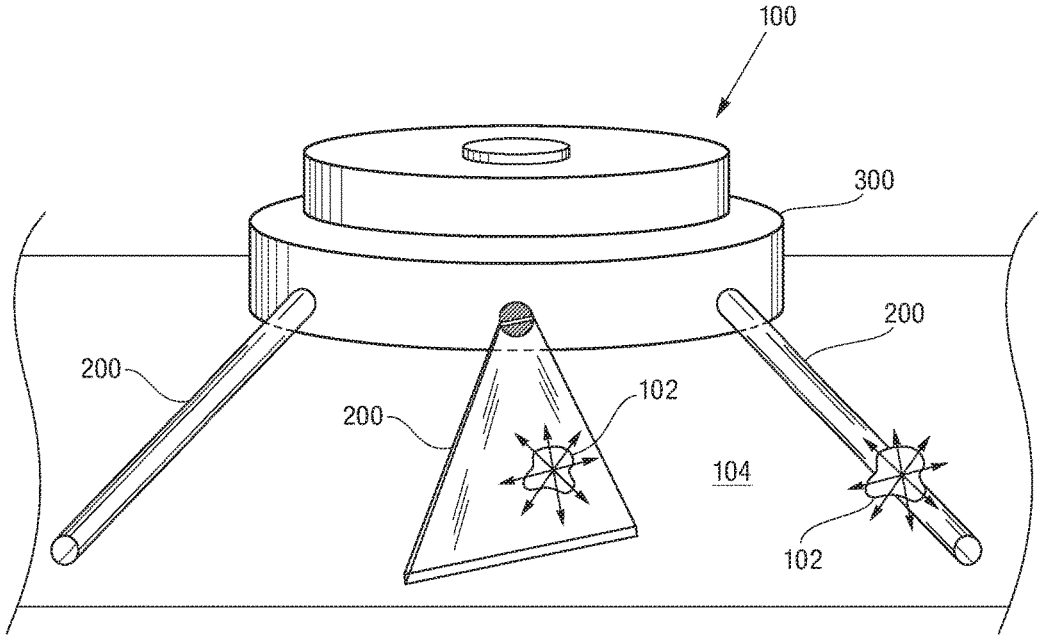
FIG. 1 depicts a perspective view of a system for illuminating an object on a surface, in accordance with one embodiment of the present disclosure.

FIG. 1 depicts an embodiment of system 100. System 100 may generally comprise one or more light sources 201 (not shown) configured to generate a plurality of light beams 200, a body 300, an emission region 400 (not shown) disposed about a periphery of body 300, and an illumination zone 500 projecting from the emission region, as described in more detail herein.

Light Beams 200

Figure 2A:
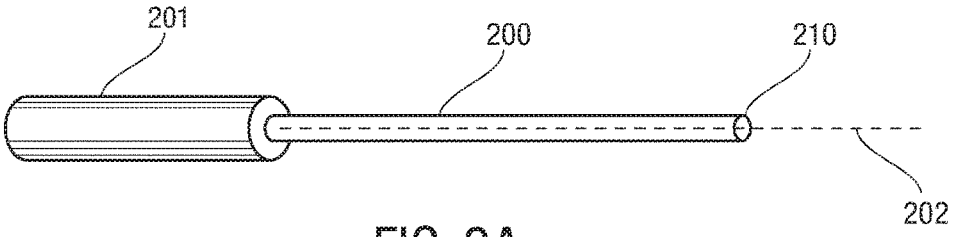
FIG. 2A depicts a perspective view of a light source generating a light beam, in accordance with one embodiment of the present disclosure.
Figure 2B:
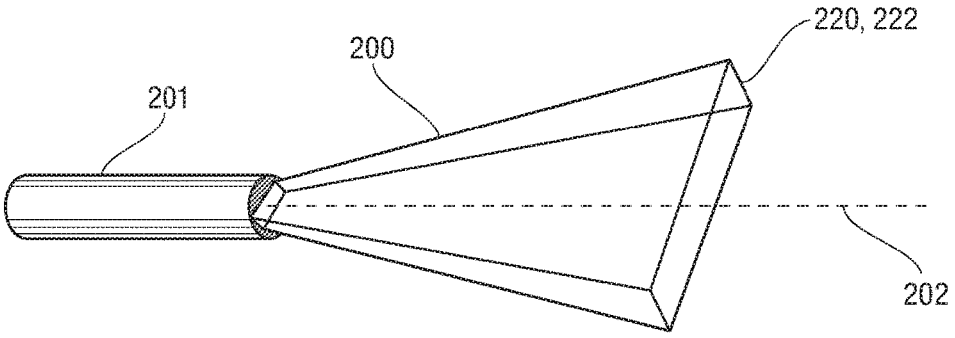
FIG. 2B depicts a perspective view of a light source generating a light beam, in accordance with one embodiment of the present disclosure.

Referring now to FIGS. 2A and 2B, system 100 may comprise one or more light sources 201 configured to generate a plurality of light beams 200. Light sources 201 may be of any type suitable to generate a plurality of light beams 200, such a laser, light emitting diode (LED), incandescent light bulb, electrical lamp, chemical lamp, incandescent light bulb, and the like. In an embodiment, system 100 may comprise more than one type of light source 201. In various embodiments, system 100 may comprise a corresponding number of light sources 201 as generated light beams 200. In another embodiment, system 100 may comprise fewer light sources 201 than generated light beams 200—that is, a given light source 201 may be configured to generate more than one beam 200 at a time. For example, in an embodiment, light from a given light source 201 may be directed through multiple apertures in light source 201 or body 300 (later described) to form a corresponding number of light beams 200. As another example, light from a given light source 201 may be split into multiple beams 200 via a mirror or other suitable mechanism. It should be appreciated that other embodiments may exist within the scope of this disclosure, and that the present disclosure should not be limited to these particular embodiments.

Figure 2C:
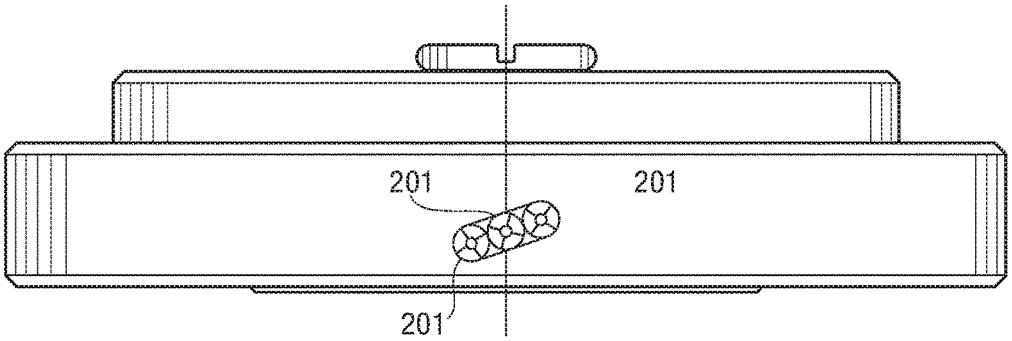
FIG. 2C depicts a front view of multiple light sources for generating light beams, in accordance with one embodiment of the present disclosure.

Light beam 200 may be of any shape and intensity suitable to illuminate an object 102 in its path. In some embodiments, cross-sectional dimensions of light beam 200 may remain substantially uniform throughout the length of the beam. In other embodiments, these dimensions may expand throughout the length of the beam. Referring to FIG. 2A, in various embodiments, light beam 200 may comprise a substantially circular cross section 210. Referring to FIG. 2B, in various embodiments, light beam 200 may comprise a substantially non-circular cross section 220. In an embodiment, non-circular cross section 220 may comprise a substantially line-shaped cross section 222 as shown in FIG. 2B. It should be recognized that a line-shaped cross section 222 may be generated from a single light source 201 (perhaps with a lens having a line-shaped opening through which light may be emitted), or, as shown in FIG. 2C, by positioning and directing multiple beams 200 in a manner suitable to form an effective beam having a line-shaped cross section 222. For example, multiple light sources 201 (such as those having circular cross sections 210) may be arranged proximate to one another in a common plane to form an effective beam having a line-shaped cross section 222. In some cases, this may be less expensive than sourcing light sources having specialized cross sectional shapes, and may produce a more intense beam 200. In another embodiment, non-circular cross section 220 may comprise a substantially elongated cross section, such as an oval or rectangle (not shown). In various embodiments, light beam 200 may be rotated about a beam axis 202 to have a particular orientation 430 relative to axis 202. For example, line-shaped beam 222 may be reoriented about beam axis 202 similar to the way wings of an aircraft rotate in a barrel roll maneuver about a fore-aft (nose-tail) centerline. In various embodiments, plurality of light beams 200 may comprise multiple beam colors. Certain colors may reflect off of certain objects better than others or provide better resolution against certain color surfaces. One having ordinary skill in the art will recognize desirable beam colors for a given application within the scope of the present disclosure.

Body 300

Figure 3A:
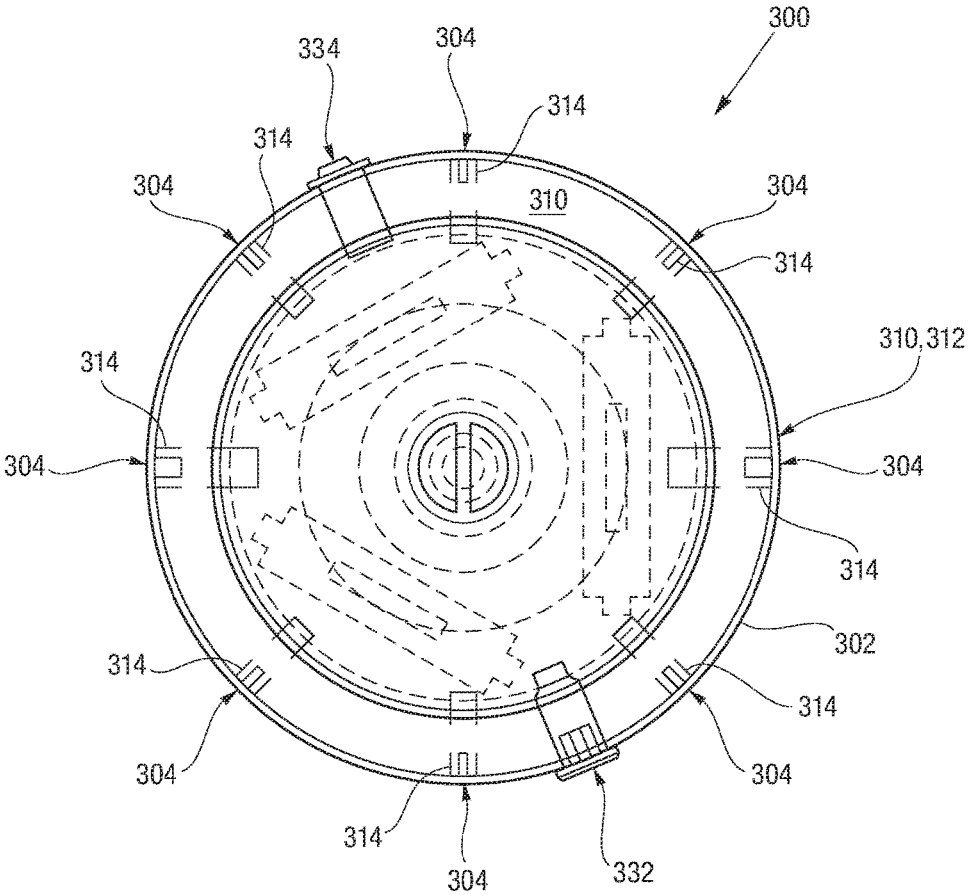
FIG. 3A depicts a top view of a system for illuminating an object on a surface, in accordance with one embodiment of the present disclosure.
Figure 3B:
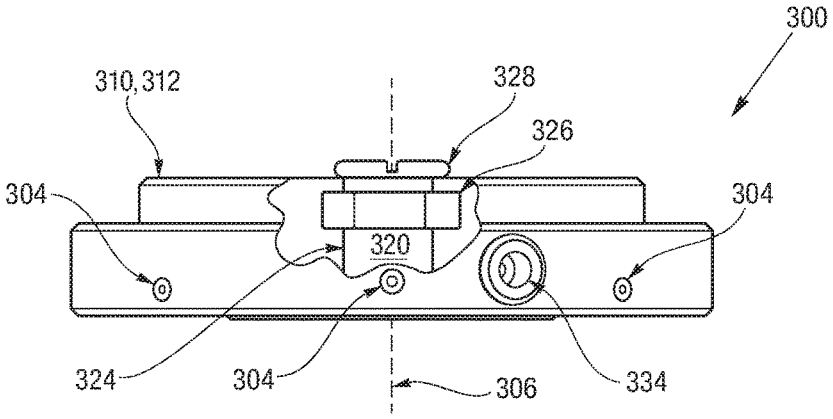
FIG. 3B depicts a side view of the system of FIG. 3A, in accordance with one embodiment of the present disclosure.
Figure 3C:
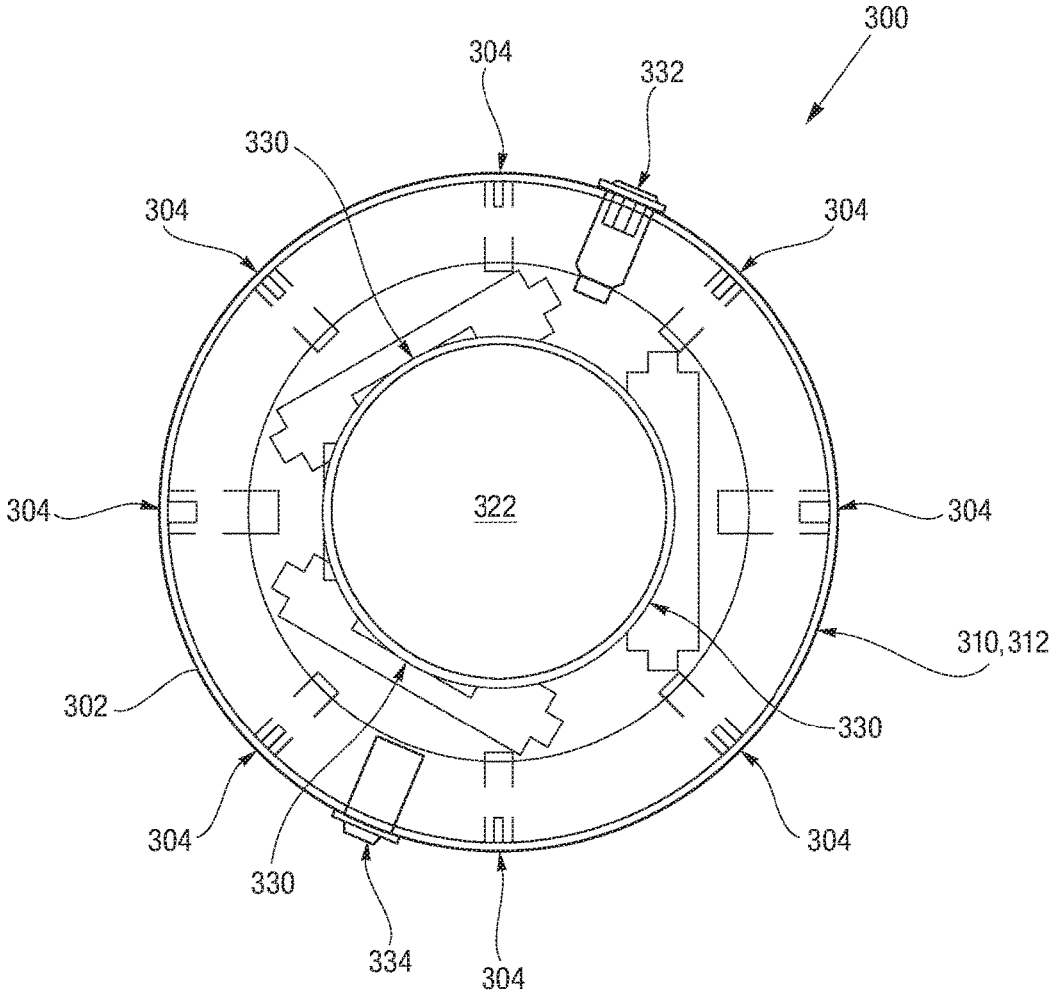
FIG. 3C depicts a bottom view of the system of FIG. 3A, in accordance with one embodiment of the present disclosure.

Referring now to FIGS. 3A-C, system 100 may comprise a body 300 configured to direct light beams 200. Body 300 may be of any size, shape, material, and construction suitable to house light sources 201 (not shown) and/or vector light beams 200 (not shown) to emission region 400 (later described). Body 300 may comprise any suitable material including, but not limited to, plastic, wood, or metal, and may be formed via any suitable manufacturing method, such as injection molding, extrusion, additive methods (3-D printing, etc.), and the like. In various embodiments, body 300 may comprise an outer surface 302 having one or more openings 304 through which a light beam 200 may be emitted. It should be recognized that openings 304 may comprise any suitable configuration including, but not limited to, individual openings for each beam 200, and one or more elongated openings (perhaps similar to a slit window in a military pillbox) in outer surface 302 through which multiple beams 200 may be emitted. In various embodiments, body 300 may house one or more power sources (such as batteries 330 and a charging port 332 as shown in FIG. 3C) in electrical connection with light source(s) 201. In an embodiment, body 300 may further include controls for operating various features of system 100, such as a general power switch 334 as shown in FIG. 3C, a light source selector for selecting which light sources to operate (not shown), a rotation controller for controlling motorized rotation of system 100 (not shown), etc. One having ordinary skill in the art will recognize suitable size, shape, material, and construction for a given application in accordance with the present disclosure.

Referring to FIG. 3A, body 300 may include one or more placement mechanisms 310 configured to vector light beams 200 (not shown) through an emission region 400 (not shown) located about a periphery of body 300 (later described). In various embodiments, placement mechanism 310 may accomplish this by locating and directing the corresponding light source 201 from which the beam 200 is emitted. In one such embodiment, placement mechanism 310 may comprise laser compartment 312 having a plurality of supports 314 for supporting a light source 201 in a given position, direction, and possibly, orientation. Supports 314 may be molded or otherwise integrated with body 300 (shown here as channels for holding cylindrical light sources 201) or instead, coupled with body 300. In some embodiments, supports may be situated behind outer wall 302 such that light sources 201 emit beams 200 emit through opening (s) 304 therein. Referring ahead to FIG. 4B, in another such embodiment, placement mechanism 310 may comprise one or more arms 316. Arms 316 may comprise a proximal end coupled to a central element 318 (such as a mast or base), and a distal end extending outwards therefrom. In various embodiments, arms 316 may be adjustable to modify a location, direction, and possibly an orientation (about beam axis 202) of light beam 200 emitted from a light source 201 coupled to the distal end of each arm 316. For example, in one embodiment, arm 316 may be bent, twisted, or otherwise modified in shape, similar to malleable limbs of an artificial Christmas tree. One having ordinary skill in the art will recognize a number of constructions suitable for positioning, directing, and possibly orienting light source 201, and thereby light beam 200, for a given application, and that the present disclosure should not be limited to the specific embodiments set forth herein.

In various other embodiments, placement mechanism 310 may be configured to vector light from light source 201 to an emission location via a conduit or other suitable structure (not shown). For example, in an embodiment, beam 200 may be routed from light source 201 to opening 304 in outer surface 302 via a fiber optic cable, mirrors, or other suitable optical coupling. As another example, body 300 may comprise a construction (perhaps including internal channels, apertures, or other suitable structure) suitable to form light beams 200 from light radiated by a light source 201 in an interior portion of body 300, and position, direct, and possibly orient said beams through emission region 400 about a periphery of body 300 (later described). One having ordinary skill in the art will recognize a number of constructions suitable for vectoring light beam 200 from light source 201 to an emission location for a given application, and that the present disclosure should not be limited to the specific embodiments set forth herein.

Referring to FIG. 3B, body 300 may further comprise a rotation mechanism 320 for rotating body 300 about a body axis 306. Rotation mechanism 320 may comprise any mechanism known in the art providing for rotation of light beams 200 about a body axis 306. It should be recognized that light beams 200 may be rotated in concert with body 300 or separate therefrom. Referring to FIG. 3C, in various embodiments, body 300 may comprise a base 322 to which placement mechanism 310 is rotatably coupled. Referring back to FIG. 3B, in an embodiment, base 322 may comprise a projection 324 configured for rotatably coupling with laser compartment 312 via a bearing 326 and a screw 328. Bearing 326 may be press fit to projection 324, and screw 328 may hold bearing 236 to projection 324, as well as prevent an inner race of bearing 326 from turning. Base may further comprise a slip-resistant material, such as a rubber pad, to keep it from spinning on surface 104. It should be recognized that this embodiment is merely illustrative, and the present disclosure should not be limited only thereto. It should be further recognized that light beams 200 may be rotated about body axis 306 by any suitable means including, but not limited to, manually or via motorized power.

In still another embodiment, body 300 may be waterproof/water resistant for use in aqueous or other liquid environments. In an embodiment, body 300 may be positively or neutrally buoyant, providing for system 100 to float on or just below surface 104 of a liquid volume like a swimming pool. Such an embodiment may be useful for locating debris floating on or slightly below the water surface. In another embodiment, body 300 may be negatively buoyant, providing for system 100 to sink to surface 104 at the bottom of a liquid volume like a swimming pool. Such an embodiment may be useful for locating broken glass, jewelry, debris, or other objects on the pool bottom.

Emission Region 400

Figure 4A:
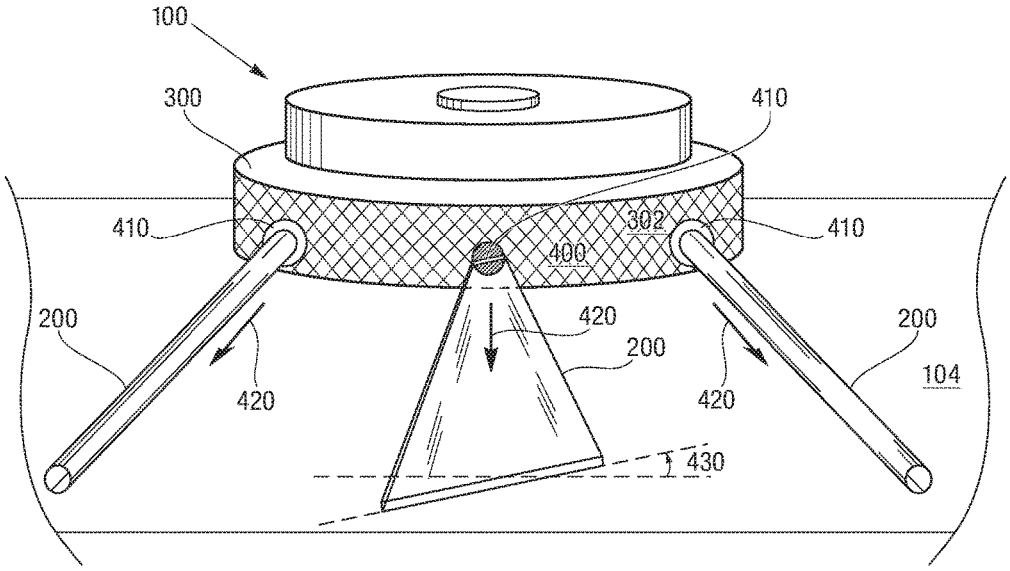
FIG. 4A depicts a perspective view of a system for illuminating an object on a surface, in accordance with one embodiment of the present disclosure.
Figure 4B:
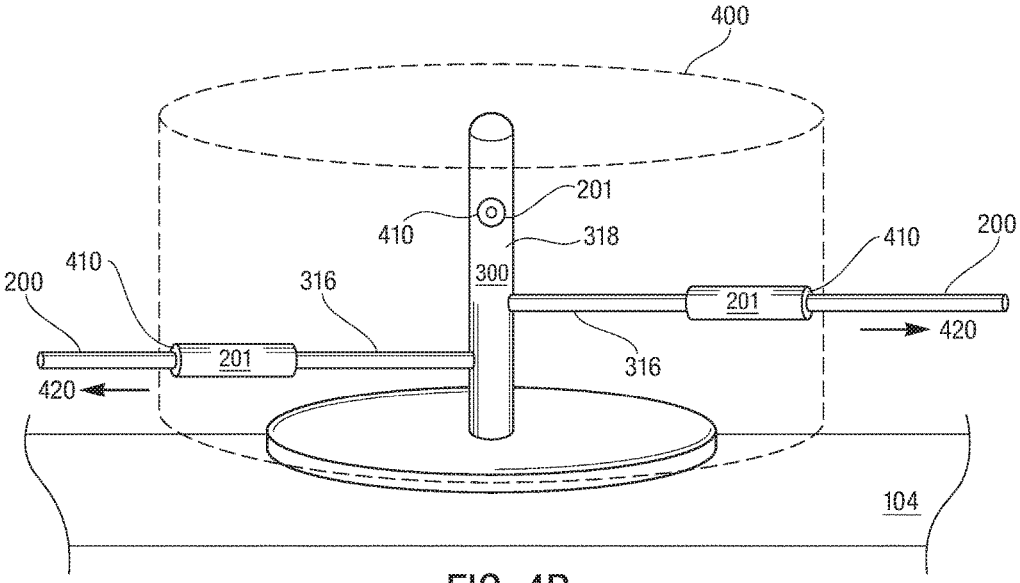
FIG. 4B depicts a perspective view of a system for illuminating an object on a surface, in accordance with one embodiment of the present disclosure.
Figure 4C:
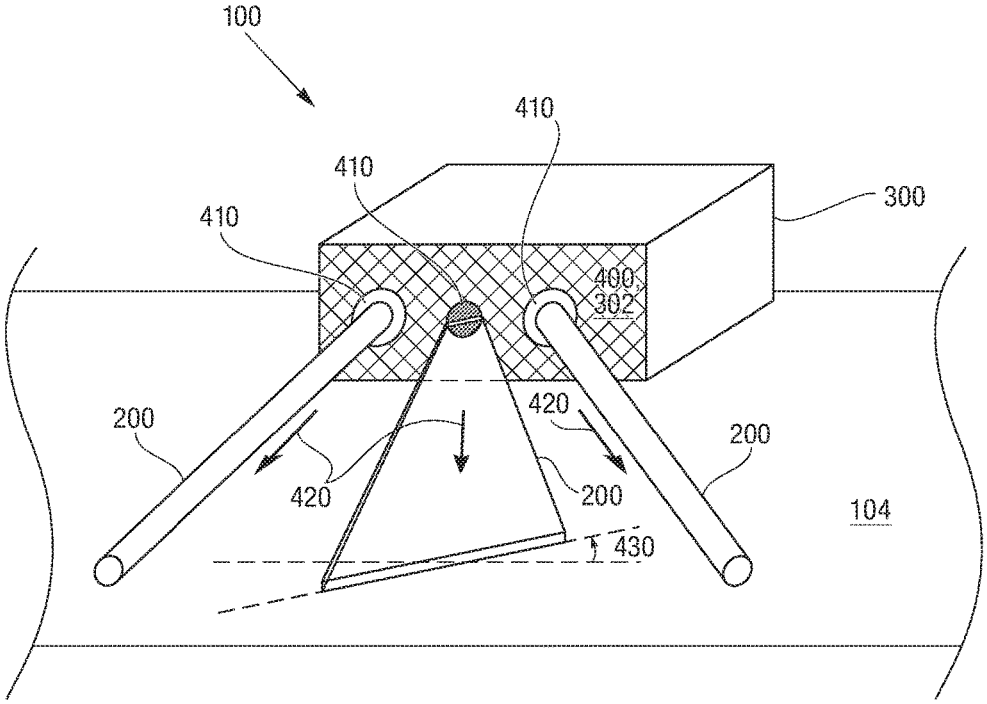
FIG. 4C depicts a perspective view of a system for illuminating an object on a surface, in accordance with one embodiment of the present disclosure.

Referring now to FIGS. 4A-C, system 100 may include an emission region 400 from which plurality of laser beams 200 is emitted. In various embodiments, emission region 400 may be disposed about a periphery of body 300. For example, in an embodiment, this periphery of body 300 may correspond with outer surface 302 of body 300 as shown in FIGS. 4A and 4C. This example may be particularly applicable to embodiments of system 100 in which light sources 201 are disposed within body 300 and emit light beams 200 through opening(s) 304 of outer surface 302. As another example, in various embodiments, this periphery may be defined outside of body 300 as shown in FIG. 4B. This example may be particularly applicable to embodiments of system 100 in which light sources 201 are disposed outside of body 300, as may be the case with Christmas tree style body 300 shown in FIG. 4B. Because laser beams 200 are not emitted from body 300 in such a configuration, but rather from laser sources 201 disposed outside of body 300, emission region 400 may be defined about a periphery of body 300 corresponding with an origination point of each light beam 200.

Light beam 200 may emit from emission region 400. More particularly, in various embodiments, light beam 200 may emit from a location 410 on emission region 400, and in a direction 420 therefrom. In an embodiment, placement mechanism 310 may be configured to vector light beam 200 to emit from location 410 and in direction 420. Location 410 and direction 420 may be factors in determining placement of light beam 200 outside of emission region 400. Stated otherwise, placement of a given light beam 200 emitted from emission region 400 is a function of location 410 and direction 420. In various embodiments, opening(s) 304 may coincide with locations 410. In an embodiment, a corresponding number of openings 304 as beams 200, or a shared opening 304, may be disposed on outer surface 302 in predetermined locations 410. In another embodiment, opening(s) 304 may be adjusted between various locations 410 on outer surface 302. For example, in an embodiment, an opening 304 may be adjusted vertically on outer surface 302 or horizontally on outer surface 302. Similarly, positions of laser sources 201 (or conduits routing beams 200 to outer surface 302) may be adjusted to emit beams 200 from various locations 410 coinciding with openings 304. For example, a laser source 201 may slide horizontally or vertically within body 300 so as to emit from one of several openings 304 (or another area of a common opening) within that adjustment plane.

Placement may further be a function of orientation 430 of light beam 200, and in particular, in connection with non-circular light beams 220. In an embodiment, non-circular light beam 220 may be rotated away from parallel to surface 104 to increase the height of an illumination zone 500 (later described) defined by placement of that beam 220. Generally speaking, rotation of non-circular light beam 220 away from parallel to surface 104 may result in wider vertical coverage and narrower horizontal coverage; conversely, a more parallel with surface 104 results in wider horizontal coverage and narrower vertical coverage.

Illumination Zone 500

Figure 5:
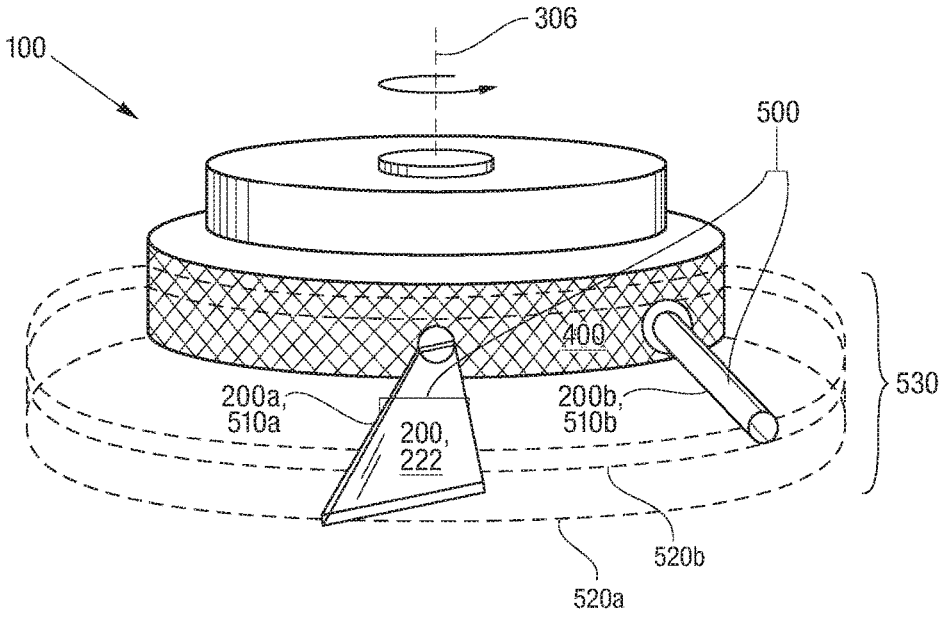
FIG. 5 depicts a perspective view of a system for illuminating an object on a surface, in accordance with one embodiment of the present disclosure.

Referring now to FIG. 5, system 100 may comprise an illumination zone 500 projecting from emission region 400. Illumination zone 500 may generally comprise those areas illuminated by light beam(s) 200 of system 100. Accordingly, illumination zone 500 may be defined by placement(s) of light beam(s) 200 emitted from emission region 400.

In various embodiments, illumination zone 500 may comprise illumination subzones 510, one for each beam 200. In various embodiments, subzones 510 may be separate from one another (as shown in FIG. 5), and in other embodiments, may adjoin or overlap. In various embodiments, movement of system 100 may extend illumination zone 500 in a corresponding manner to form an effective illumination zone 520. For example, as shown in FIG. 5, in various embodiments, rotation of system 100 about body axis 306 may extend each illumination zone 510*a*, 510*b* circumferentially about body 300 to form effective illumination zones 520*a*, 520*b*. In various embodiments, effective illumination zones 520*a*, 520*b* may adjoin or overlap; in others, they may be separate. In an embodiment, adjoining or overlapping effective illumination zones 520 may form a contiguous effective illumination zone 530. Illumination zone 530 may be configured to illuminate an object disposed anywhere therein. For example, as shown in FIG. 5, beams may be placed at staggered vertical locations such that their individual illumination subzones 510*a*, 510*b* form effective illumination zones 520*a*, 520*b* that adjoin or overlap when rotated, thereby illuminating any object 102 within contiguous illumination zone 530. Such a configuration may ensure that any object disposed between the uppermost beam and the lowermost beam would fall within contiguous effective illumination zone 530 and thus be illuminated at some point during rotation. It should be recognized that beams 200 may be placed in a number of possible arrangements that would form a contiguous effective illumination zone 530.

It should be recognized that illumination zone 500 may be projected in a manner to maximize illumination of an object(s) 102 to be identified. For example, in an embodiment, placement of a line-shaped beam 222 at an orientation 430 angled away from parallel with surface 104, from a location 410 proximate to surface 104, and in a direction 420 substantially parallel to surface 104 may maximize illumination of smaller objects 102 on the surface 104. In this configuration, beam 222 may strike surface 104 over the portion of its width (mostly that portion tilted downward from parallel), thereby ensuring illumination of objects 102 on surface 104 of any size. A remaining portion (mostly that portion tiled upward from parallel) may project above surface 104 at increasing heights over its remaining width (due to the tilt). In a rotating embodiment, this portion (along with the downward tilted portion) may illuminate object 102 over the subportion of its width having a height at or below the height of the object 102. It should be recognized that for a given direction 420, these portions may be adjusted by adjusting either the height of location 410 or the angle of orientation 430. For example, lowering location 410 may result in a greater portion of beam 222 striking surface 104 for a given orientation 430; conversely, raising location 410 may decrease that portion striking surface 104 and therefore increase an overall height covered by the beam. As another example, increasing the tilt orientation 430 of line-shaped beam 222 may result in a greater portion of beam 22 striking surface 104 for a given location 410 and narrow the horizontal coverage of the beam; conversely, decreasing the tilt may increase that portion projecting above surface 104 and widen the horizontal coverage of the beam. Similarly, placement of beams 200 may affect the distance from emission region 400 at which the light projects. These examples illustrate just a couple of ways a beam 200 may be placed in a manner to maximize illumination of an object 102 to be identified. One having ordinary skill in the art will recognize desirable combinations of location 410 from which, direction 420 in which, and orientation 430 of light beams 200.

It follows that, in various embodiments, characteristics of the object 102 may be considered in determining a placement of beam 200 to maximize illumination of the object. For example, the size of the object 102 and the degree to which it visible reflects/refracts light may affect a desired placement of beams 200. Similarly, the area over which the object(s) 102 may be distributed, and whether or not the objects are on, above, or below surface 104 may further affect desirable placement of beams 200. It should be recognized that other factors may be considered in placing beams 200, and one having ordinary skill in the art will recognize desirable placement of beams 200 in a given application based on characteristics of the object(s) 102, where the object(s) 102 may be spatially, as well as other applicable factors.

EXAMPLE I

In various embodiments, multiple dot-shaped lasers, line-shaped lasers, or a combination thereof are emitted from a rotating cylindrical body. The lasers are substantially equally spaced on an outer surface of the body, and are directed radially away from the body and substantially parallel to the surface to be examined. The lasers could be coplanar or staggered at varying vertical heights, with at least one laser being located just above the surface. The line-shaped lasers may have identical or varying orientations about a beam axis of each. In an embodiment, each is oriented approximately five degrees askew from parallel to the surface.

In operation, the body rotates, sweeping the lasers about the system. As viewed from above, individual lasers project from and follow the spinning body like bicycle wheel spokes, forming an effectively circular illumination zone. As viewed from the side, an effectively rectangular illumination zone projects outward from the body to the left and right. It has a height corresponding to the vertical distance between the lowest laser and the highest laser. Each line-shaped laser may appear thicker than the dot-shaped lasers due to the vertical component in their orientations.

In one aspect, dot-shaped lasers disposed at heights equal to or less than that of an object on the surface illuminate the object as each sweeps across it. The object is not illuminated by any dot-shaped lasers situated higher than the object. The dot-shaped lasers are very concentrated and thereby brightly reflect off/refract within the object. In another aspect, the object is illuminated by each line-shaped laser on every pass. The line-shaped lasers may not be as concentrated as the dot lasers, thus reflection/refraction may not be as bright as if it accomplished with a dot laser; however, each line-shaped laser spans horizontally and vertically, ensuring the object will be illuminated (albeit less brightly) regardless of its size. This embodiment combines the advantages of concentrated circular laser beams and broad non-circular laser beams, thereby reducing the time it may take to find an object, and improving confidence that any and all objects present are found.

EXAMPLE II

In various embodiments, circular beams, line-shaped beams, or a combination thereof are emitted from a nonrotating body. The beams emit from an outer surface of the body, and are directed in a generally common direction substantially parallel to one another. In an embodiment, the beams are directed in a plane parallel to a surface to be examined. In another embodiment, some of the beams may be directed somewhat upwards or downwards from a plane parallel to the surface. In yet another embodiment, some of the beams may be directed somewhat to either side of the generally common direction. The latter two embodiments may increase the span of the illumination zone of the system.

In operation, the beams may be directed towards an area the object is thought to possibly be located. The system may be swept about that area in any suitable search pattern until the object is illuminated. As viewed from above, individual beams project from the body, forming an effectively rectangular or fan shaped (spreading out horizontally) illumination zone. It has a horizontal dimension corresponding to the angle between the most leftwardly directed beam and the most rightwardly directed beam. As viewed from the side, an effectively rectangular or fan shaped (spreading out vertically) illumination zone projects outward from the body in the generally common direction. It has a height corresponding to the angle between the most upwardly directed beam and the most downwardly directed beam. Circular shaped beams and line-shaped beams may exhibit similar illuminative qualities as dot-shaped lasers and line-shaped lasers described in Example I.

EXAMPLE III

Figure 6A:
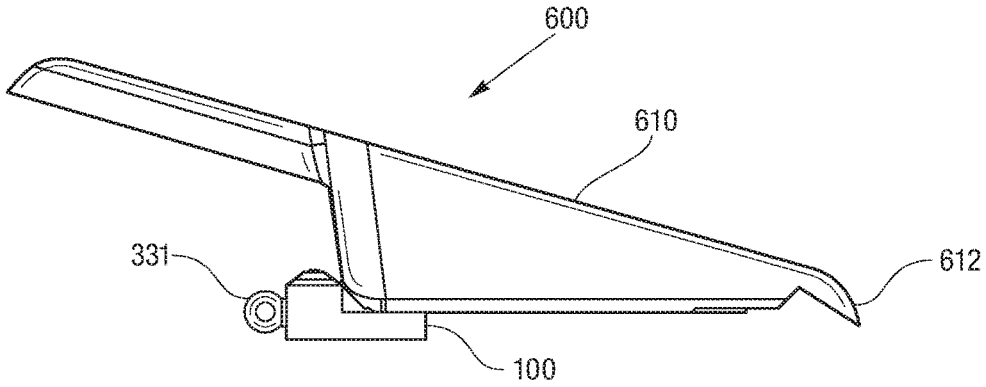
FIG. 6A depicts a side view of a dustpan system for illuminating an object on a surface, in accordance with one embodiment of the present disclosure.
Figure 6B:
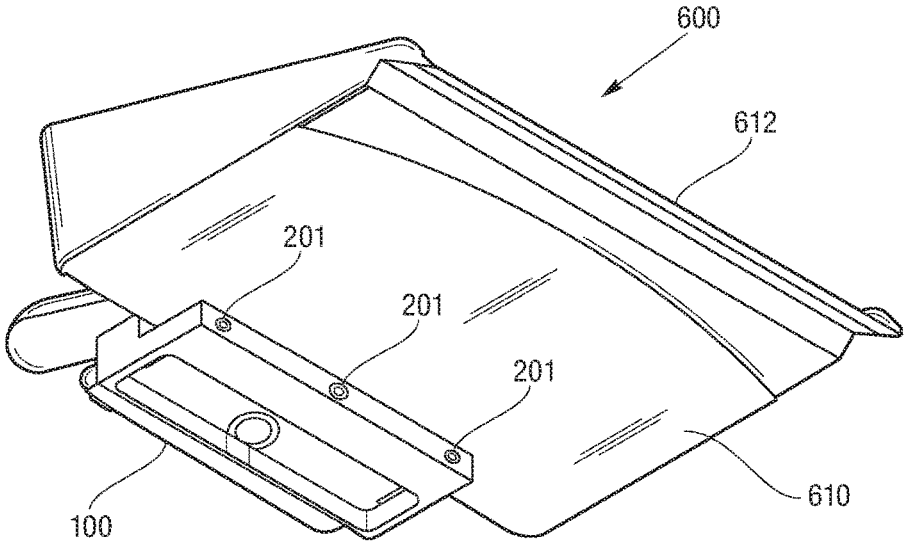
FIG. 6B depicts a perspective view of the system of FIG. 6A, in accordance with one embodiment of the present disclosure.
Figure 6C:
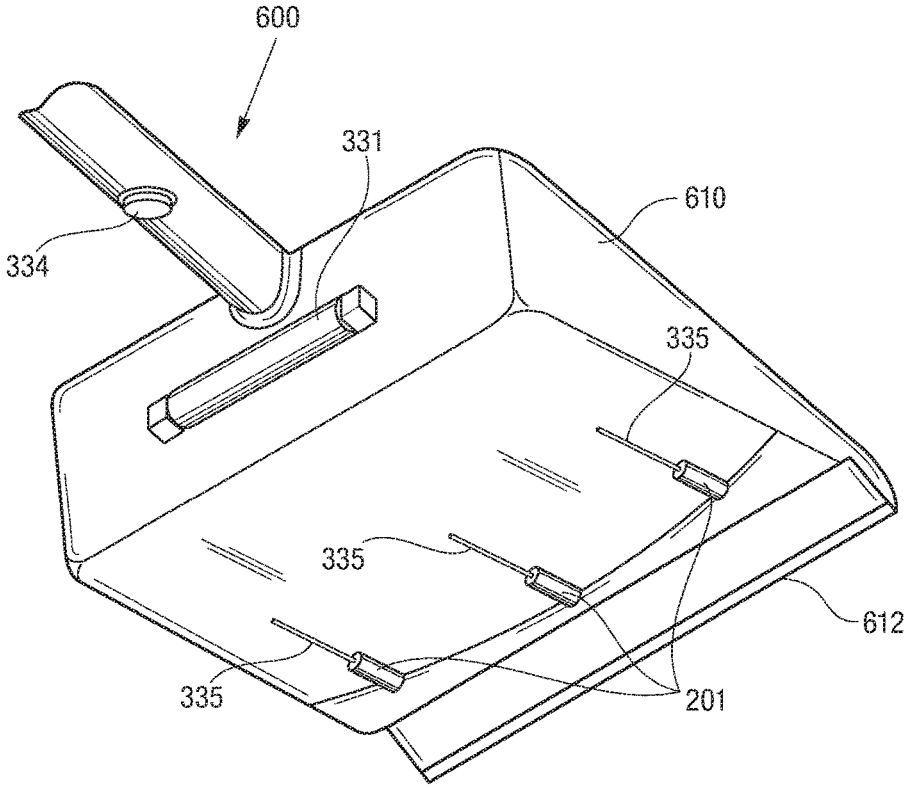
FIG. 6C depicts a perspective view of a dustpan system for illuminating an object on a surface, in accordance with one embodiment of the present disclosure.

Referring now to FIGS. 6A-6C, in various embodiments, a dustpan system 600 may comprise system 100 coupled with a dustpan 610 and configured to project a zone of illumination in front of the dustpan opening 612. Referring to FIGS. 6A and 6B, in an embodiment, a system 100 may be configured to attach to a portion of a dustpan 610, such as a bottom portion as shown, such that laser sources 201 are directed toward opening 612 of dustpan 610. One or more laser sources 201 may be directed generally toward opening 612 of dustpan 610. While not restricted as such, embodiments configured to attach to a dustpan may be desirable for upgrading standard commercial dustpans 610 at little cost and effort. Referring to FIG. 6C, in an embodiment, system 100 may be integrated within a dustpan 610 to form a dustpan system 600. For example, one or more laser sources 201 may be positioned along a bottom portion of dustpan 610 and directed generally toward opening 612 of dustpan 610. Laser sources 201 may be in electrical connection with a power source (such as batteries 330 (not shown) within a battery compartment 331) and any other controls (such as power switch 334) included in system 100, perhaps via wires 335 (only partially shown). For clarity sake, the term "coupled" as used in connection with these dustpan embodiments may encompasses embodiments of the system configured to attach to a dustpan in any suitable manner, as well as embodiments wherein the system is integrated with (included within or as part of) a dustpan. In operation, dustpan embodiments may be moved along a sweep path as later described to help find objects 102, and/or may be placed on surface 104 to illuminate objects 102 while a user sweeps them into the dustpan with a broom. It should be recognized that similar systems may be configured and operated as previously described, such as a standard or hand-held vacuum.

In yet another embodiment, the system may be configured to be worn by a user. For example, the system may comprise a wrist strap, ankle strap, or a head band, allowing the system to be conveniently carried and directed during the search for and recovery of an object on a surface. In operation, a user may direct and sweep the system by moving the portion of his or her body to which the system is coupled. An embodiment configured for wear on the head may provide for naturally directing and sweeping the illumination zone in real-time accordance with the user's visual plane. An embodiment configured for wear on the ankle may provide the user with an illumination zone about his or her feet as he or she searches or cleans the surface.

Operation

In operation, the system may be used to illuminate one or more objects on a surface. Illumination may help to visually distinguish an object from the surface, thereby providing for a user to locate and recover the object. For example, illumination of the object may produce a visible reflection of light off a surface of the object, such as glare or a difference in color distinguishable from the surface. Similarly, illumination of the object may produce a visible refraction of light as it passes through the object, such as a glowing or sparkling effect resulting as light passes through a transparent object like a glass shard (depicted by arrows radiating from within object 102 in FIG. 1). It should be recognized that any visually detectable effect resulting from illumination of the object, and not just these particular illustrative embodiments, is in accordance with the present disclosure.

In operation, a method of illuminating an object on a surface may comprise generating a plurality of light beams from one or more light sources. As previously described, the plurality of light beams may be generated from a corresponding number of light sources or from fewer light sources than beams. Light beams of any suitable shape may be generated including, but not limited to, those having either substantially circular or non-circular cross sections, as well as beams having or lacking uniformity throughout their respective lengths. In an embodiment, one or more line-shaped light beams is generated. In another embodiment, one or more circular-shaped light beams is generated.

The method may further comprise placing the plurality of light beams to define an illumination zone. In various embodiments, placing the plurality of light beams may comprise selecting a corresponding location from which each light beam is emitted. For example, in an embodiment, some or all of the light beams may be placed in locations vertically offset from one another, thereby possibly providing for expanded coverage of an effective illumination zone defined thereby. As another example, in an embodiment, some or all of the light beams may be placed in locations about the system in a manner configured to illuminate small objects that rise only a small vertical distance from the surface. In various embodiments, placing the plurality of light beams may comprise selecting a corresponding direction in which each light beam is emitted. For example, in an embodiment, some or all of the light beams may be placed with directions substantially parallel to the surface. As another example, in an embodiment, some or all of the light beams may be placed with directions suitable to cause the beams to adjoin or partially overlap at a distance, thereby possibly providing for expanded coverage of an effective illumination zone defined by the non-overlapping boundaries of those light beams. In various embodiments, placing the plurality of light beams may comprise selecting a corresponding orientation of each emitted light beam. For example, in an embodiment, some or all of the light beams may be placed with a orientations slightly skewed from parallel to the surface, thereby defining a wide illumination zone for each such beam that also has a vertical component for illuminating objects of various heights. In an embodiment, a line-shaped light beam may be placed proximate to the surface and substantially parallel thereto, and oriented slightly askew from parallel to the surface. Such an embodiment may provide for a horizontally wide beam that projects along the surface and slightly above (depending on the angle of orientation), thereby providing a broad illumination zone that should illuminate any object on the surface within range of the beam, regardless of the height of the object. In various embodiments, placing the plurality of light beams may comprise rotating the plurality of light beams about an axis of the system. This may involve rotating the at least a portion of the system along with the light beams, or rotating the light beams primarily. In an embodiment, the plurality of light beams may be rotated about an axis of the system orthogonal to the surface on which or over which the system may be positioned. In some embodiments, the light beams may be rotated about a vertical axis of the system. In an embodiment, the plurality of light beams may be rotated manually, perhaps by a simple flick of the wrist. In another embodiment, the plurality of light beams may be rotated by a motor. Placement of the plurality of light beams by rotation may define an broader effective illumination zone than that defined by individual beams. For example, in an embodiment, rotation may define an effective illumination zone having a substantially circular (or arced shape if not full rotation).

The method may further comprise positioning the system such that the object falls within the illumination zone formed by the plurality of light beams. The system may be positioned at any suitable distance from, and in any suitable orientation relative to the object such that one or more of the plurality of light beams illuminates the object. In various embodiments, the system may be positioned on the surface on which the object rests. In various embodiments, the system may be positioned above the surface on which the object rests. If the general location of the object is known, the system may be positioned proximate to the object, which may have the benefit of illuminating the object with higher intensity light.

In various embodiments, the system may be used to locate an object(s) known to be present on a surface. For example, system 100 may be used to find a loose diamond dropped by a jewelry store patron shopping for an engagement ring. In various embodiments, the system may be used to ascertain whether an object(s) are present on a surface when a user is unsure. For example, the system may be used to determine if any nails, broken glass, or other tire hazards are present on the floor of a garage before pulling a vehicle into the garage. If the general location of the object is unknown, the system may be repositioned until the object falls within the illumination zone formed by the plurality of light beams. Similarly, if it is unknown whether the object is present on the surface, the system may be repositioned until all portions of the surface have been within the illumination zone, thereby allowing a user to confirm the presence or lack thereof of any objects on the surface. In an embodiment, positioning the system may comprise moving the system along a sweep path until the lost object is found, or until the surface has been swept for any possible unknown objects. It should be recognized that the sweep path may comprise any path which may direct the illumination zone along the surface where an object might be found. In an embodiment, the system may be configured to travel along a predetermined sweep path about and/or throughout the search area. For example, in an embodiment, the system may be moved along sweep path defined by a track, rails or similar structure positioned around a search area (such as a pool, laboratory floor, etc.).

In various embodiments, system 100 may be positioned to illuminate an object(s) known to be present on a submerged surface in a similar manner. For example, system 100 may be used to find a pair of glasses that have fallen to the bottom of a swimming pool. In various embodiments, system 100 may be used to ascertain whether an object(s) are present on a submerged surface when a user is unsure. For example, system 100 may be used to determine if any broken glass shards were cast onto the bottom of a swimming pool after a bottle was shattered on the adjoining walkway. The system may be submerged and placed on or above the submerged surface, and operated as described above to locate the lost object, or sweep for the presence of an object. In various embodiments, system 100 may be used to locate objects floating on or below a surface of a liquid. For example, system 100 may be used to determine if any insects or insect larvae are present at or near the surface of a swimming pool, either by illuminating the insects themselves, or disturbances in the liquid (ripples, etc.) around the insects. The system may be placed on the surface of the water (floating, on a platform, or in any other suitable way) and may be operated as described above to illuminate any floating or partially submerged objects.

While the present invention has been described with reference to certain embodiments thereof, it should be understood by those skilled in the art that various changes may be made and equivalents may be substituted without departing from the true spirit and scope of the invention. In addition, many modifications may be made to adapt to a particular situation, indication, material and composition of matter, process step or steps, without departing from the spirit and scope of the present invention. All such modifications are intended to be within the scope of the claims appended hereto.

What is claimed is:

1. A device for illuminating an object, the device comprising:

a light source to generate a light beam having a substantially solid fan shape;

a housing having an outer wall, a base, and one or more openings on the outer wall through which the solid fan-shaped light beam can be emitted;

a support positioned in the housing for supporting the light source to permit the solid fan-shaped light beam to be emitted through the opening in the outer wall of the housing at a slanted orientation relative to the housing, and illuminate the object, including both a raised portion of the object and a portion of the object adjacent to a surface on which the object is located; and a motorized rotation mechanism situated within the housing to rotate the slanted light beam about an axis of the housing by rotating the support relative to the base to sweep an illumination zone defined by the slanted light beam about a circumference of the housing.

2. A device as set forth in claim 1, the motorized rotation mechanism including a bearing rotably coupling the base and the support to permit rotation of the support relative to the base.

3. A device as set forth in claim 1, wherein the housing has a shape of a dustpan.

4. A device as set forth in claim 1, further comprising additional light sources within the housing operable to generate additional light beams.

5. A device as set forth in claim 1, wherein the solid fan-shaped light beam has an elongated cross section that is line-shaped.

6. A device as set forth in claim 1, wherein the support includes an arm and a fiber optic cable or other optical conduit.

7. A method for illuminating an object, the method comprising:

positioning, on a surface, a device, the device including a housing having an outer wall, a base, and one or more openings on the outer wall, supporting, by a support positioned within the housing, a light source for generating a substantially solid fan-shaped light beam;

emitting, through the opening on the outer wall of the housing, the solid fan-shaped light beam at a slanted orientation relative to the housing to illuminate the object, including both a raised portion of the object and a portion of the object adjacent to a surface on which the object is located; and rotating, by a motorized rotation mechanism situated within the housing, the slanted light beam about an axis of the housing by rotating the support relative to the base to sweep an illumination zone defined by the slanted light beam about a circumference of the housing.

8. A method as set forth in claim 7, wherein in the step of emitting, the solid fan-shaped light beam has an elongated cross section that is line-shaped.

9. A method as set forth in claim 7, wherein the axis of the housing is a vertical axis of the housing.

10. A method as set forth in claim 7, wherein the step of positioning comprises positioning the housing on, above, or below the surface on which the object is disposed.

11. A method as set forth in claim 7, wherein in the step of emitting, the light beam is directed at a downwards angle relative to the base.

12. A method as set forth in claim 7, wherein the step of positioning further includes directing the housing at a downwards angle relative to the surface on which the object is situated.

13. A system for illuminating an object, the system comprising:

a housing having an outer wall, a base, and an opening in the outer wall;

a light source positioned within the housing to generate a substantially solid fan-shaped light beam emmittable through the opening in the outer wall at a slanted orientation relative to the housing to illuminate the object, including both a raised portion of the object and a portion of the object adjacent to a surface on which the object is located; and a motorized rotation mechanism situated within the housing to rotate the slanted light beam about an axis of the housing by rotating the support relative to the base to sweep an illumination zone defined by the slanted light beam about a circumference of the housing.

14. A system as set forth in claim 13, wherein the light source is further positioned at a downward angle relative to the base.

15. A system as set forth in claim 13, further comprising additional light sources within the housing operable to generate additional light beams.

16. A method as set forth in claim 7, wherein the motorized rotation mechanism includes a bearing rotably coupling the base and the support to permit rotation of the support relative to the base.

17. A system as set forth in claim 13, wherein the solid fan-shaped light beam has a substantially elongated cross section.

18. A system as set forth in claim 13, wherein the motorized rotation mechanism includes a bearing rotably coupling the base and the support to permit rotation of the support relative to the base.

* * * * *